United States Patent [19]

Wingo

[11] Patent Number: 5,036,761

[45] Date of Patent: Aug. 6, 1991

[54] FORCED FLOW PRESS DAMPENING APPARATUS

[76] Inventor: Patrick Y. Wingo, 313 Market St., Nekoosa, Wis. 54457

[21] Appl. No.: 439,150

[22] Filed: Nov. 20, 1989

[51] Int. Cl.[5] ..... B41F 7/26; B41L 25/02

[52] U.S. Cl. ..... 101/148; 101/367; 101/365

[58] Field of Search ..... 101/147, 148, 365, 367, 101/331, 350, 363; 29/110, 124; 401/147, 197, 208, 220

[56] References Cited

U.S. PATENT DOCUMENTS 2,913,980 11/1959 Lindemann ..... 101/367 X
3,911,815 10/1975 Banfer .
3,923,936 12/1975 Davis et al. .
4,016,811 4/1977 Zavodny .
4,143,596 5/1979 Ivett .
4,538,514 9/1985 Simeth .

*Primary Examiner*—J. Reed Fisher
*Attorney, Agent, or Firm*—Leon Gilden

[57] ABSTRACT

An apparatus is set forth wherein a pressurized cylinder is operative to direct fluid flow from a series of compartmentalized sections within the cylinder operative through separate valving to direct the flow through metered orifices formed in a coextensive matrix pattern throughout the cylindrical wall of the cylinder, and to direct fluid from the cylinder to a plurality of water form rollers to direct the water from the cylinder onto a plate cylinder for use in printing machines.

7 Claims, 4 Drawing Sheets

PRIOR ART

FORCED FLOW PRESS DAMPENING APPARATUS

BACKGROUND OF THE INVENTION

1. Field of the Invention

The field of the invention relates to printing apparatus, and more particularly pertains to a new and improved forced flow press dampening apparatus wherein the same directs pressurized flow through a predetermined gradient onto cooperative water from rollers and to direct the fluid flow onto a plate cylinder of a printing operation.

2. Description of the Prior Art

In printing, and more particularly in lithographic printing, a press plate cylinder has a non-printing area coated with a film of fluid from a dampening system that typically comprises water with further portions of the plate cylinder treated with ink from an ink-form roller, wherein the dampening system is arranged to provide a predetermined quantity of water to provide a balanced distribution on the plate cylinder. This is desirable to avoid imparting of excess water onto portions of the cylinder not utilized in a printing procedure. To solve the water/ink relationship upon the plate cylinder, the prior art has utilized various arrangements to impart appropriate amounts of water to the aforenoted plate cylinder. Examples of the prior art include U.S. Pat. No. 4,538,514 to Simeth wherein a dampening unit for a rotary printing operation includes a metering roller that directs fluid flow from a central conduit through the roller under pressure onto cooperating form rollers.

U.S. Pat. No. 3,911,815 to Banfer sets forth a dampening mechanism for feeding a film of water utilizing a conventional pick-up roll to direct the water to cooperating rollers and direct the water therefrom ultimately to a cooperating plate cylinder.

U.S. Pat. No. 3,923,936 to Davis, et al., illustrates a roller surface configuration wherein water is directed from the roller through capillary action in an effort to properly meter the water flow therethrough.

U.S. Pat. No. 4,016,811 to Zavodny sets forth a transfer roller for use in dampening mechanisms of printing presses utilizing spiral grooves to direct desired quantities of water to a plate cylinder.

U.S. Pat. No. 4,143,596 to Ivett sets forth a dampening system utilizing a brush roller to properly transfer a predetermined quantity of fluid to a cooperating plate cylinder.

As such, it may be appreciated that there is a continuing need for a new and improved forced flow press dampening apparatus wherein the same addresses both the problems of appropriately directing desired quantities of water in a desired ratio to a press cylinder and further effectively provide valving to effect this goal.

SUMMARY OF THE INVENTION

In view of the foregoing disadvantages inherent in the known types of dampening systems for press arrangements now present in the prior art, the present invention provides an forced flow press dampening apparatus wherein the same utilizes a compartmented force flow cylinder utilizing valving and individual conduits for each compartment within the cylinder to direct predetermined quantities of fluid from the cylinder ultimately to a press cylinder. As such, the general purpose of the present invention, which will be described subsequently in greater detail, is to provide a new and improved force flow press dampening apparatus which has all the advantages of the prior art dampening systems for presses and none of the disadvantages.

To attain this, the present invention includes an apparatus wherein a pressurized cylinder is operative to direct fluid flow from a series of compartmentalized sections within the cylinder operative through separate valving to direct the flow through metered orifices formed in a coextensive matrix pattern throughout the cylindrical wall of the cylinder, and to direct fluid from the cylinder to a plurality of water form rollers to direct the water from the cylinder onto a plate cylinder for use in printing machines.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved forced flow press dampening apparatus which has all the advantages of the prior art dampening apparatus for press procedures and none of the disadvantages.

It is another object of the present invention to provide a new and improved forced flow press dampening apparatus which may be easily and efficiently manufactured and marketed.

It is a further object of the present invention to provide a new and improved forced flow press dampening apparatus which is of a durable and reliable construction.

An even further object of the present invention is to provide a new and improved flow press dampening apparatus which is susceptible of a low cost of manufacture with regard to both materials and labor, and which accordingly is then susceptible of low prices of sale to the consuming public, thereby making such forced flow press dampening apparatus economically available to the buying public.

Still yet another object of the present invention is to provide a new and improved forced flow press dampening apparatus which provides in the apparatuses and methods of the prior art some of the advantages thereof, while simultaneously overcoming some of the disadvantages normally associated therewith.

Still another object of the present invention is to provide a new and improved forced flow press dampening apparatus wherein the same utilizes a pressurized cylinder formed with a series of compartments cooperative with individual conduits with valving arranged with each conduit for directing predetermined quantities of fluid through metered orifices of the cylinder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
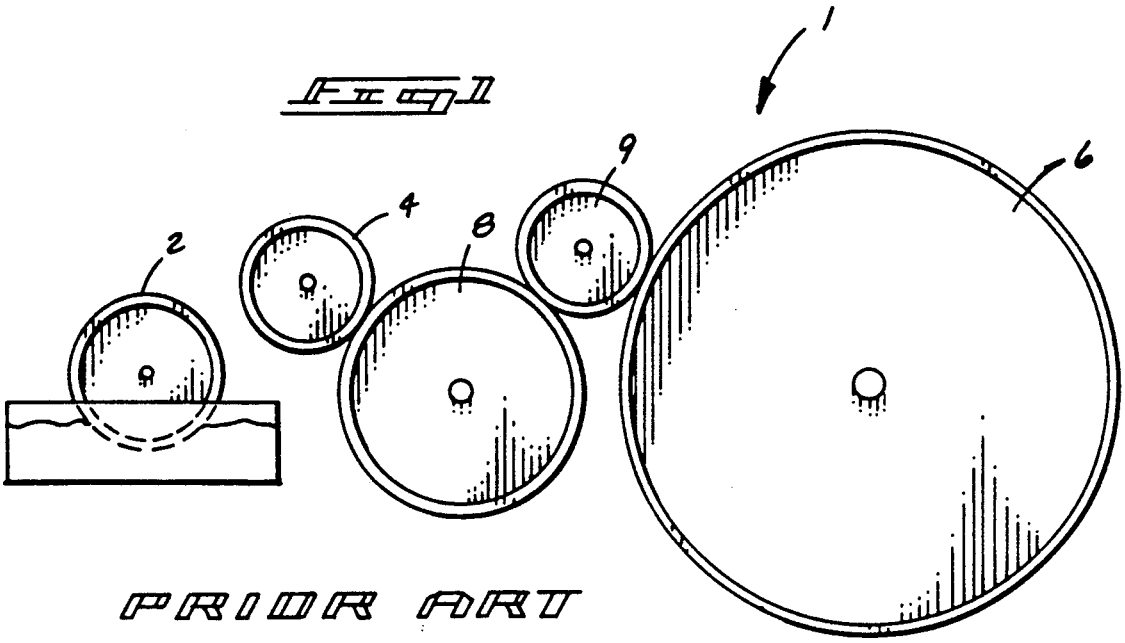
FIG. 1 is an orthographic view of a prior art dampening system.

With reference now to the drawings, and in particular to FIGS. 1 to 6 thereof, a new and improved forced flow press dampening apparatus embodying the principles and concepts of the present invention and generally designated by the reference numeral 10 will be described.

Figure 2:
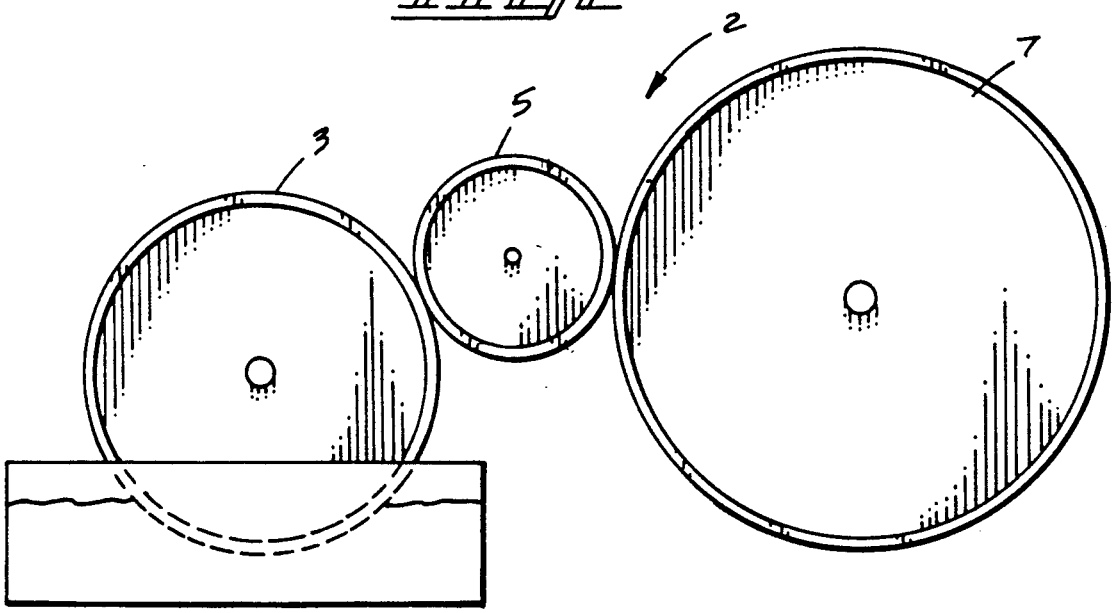
PRIOR ART FIG 2
FIG. 2 is an orthographic view of a further prior art press dampening system.

More specifically, the apparatus of the instant invention comprises an improvement over the prior art, as illustrated in FIGS. 1 and 2, wherein respective fountain roller 2 and 3 are respectively cooperative with associated rollers with a transfer roller 4 selectively engageable with the roller 2, and a water form roller 5 engageable with a roller 3 of FIG. 2. An oscillating roller 8 cooperates with the transfer roller 4 to impart the water from the roller 2 to the water form roller 9. Each of the examples of FIGS. 1 and 2 respectively direct the thusly transferred water to a plate cylinder 6 and 7. The prior art has been handicapped by the inability to properly meter the water applied to the plate cylinders and thereby provide a degree of fluiding to the plate cylinder and associated ill effects to the printing system. Further, the use of a reservoir, as illustrated in FIGS. 1 and 2, imparts a degree of contamination to the water thusly utilized as ink from the printing process is subsequently deposited within the reservoir associated with each fountain roller.

Figure 3:
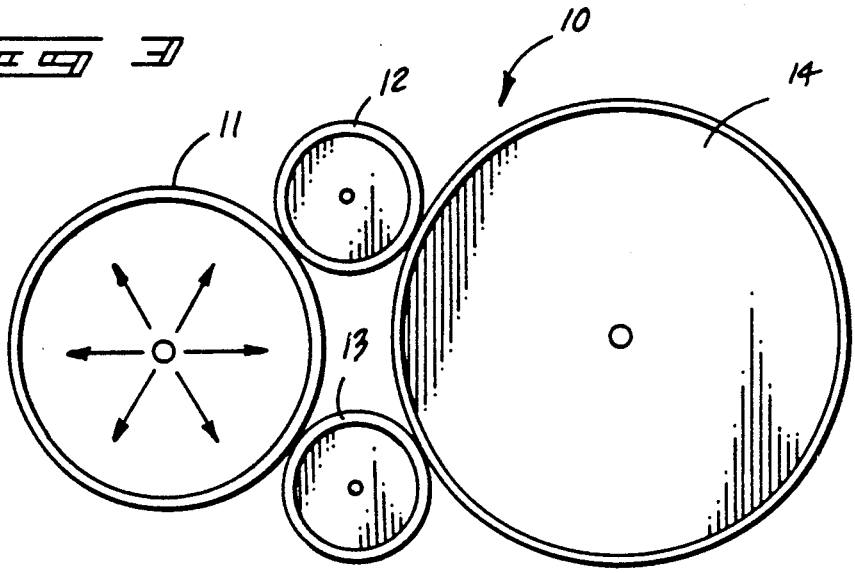
FIG. 3 is an orthographic view taken in elevation of the instant invention.
Figure 4:
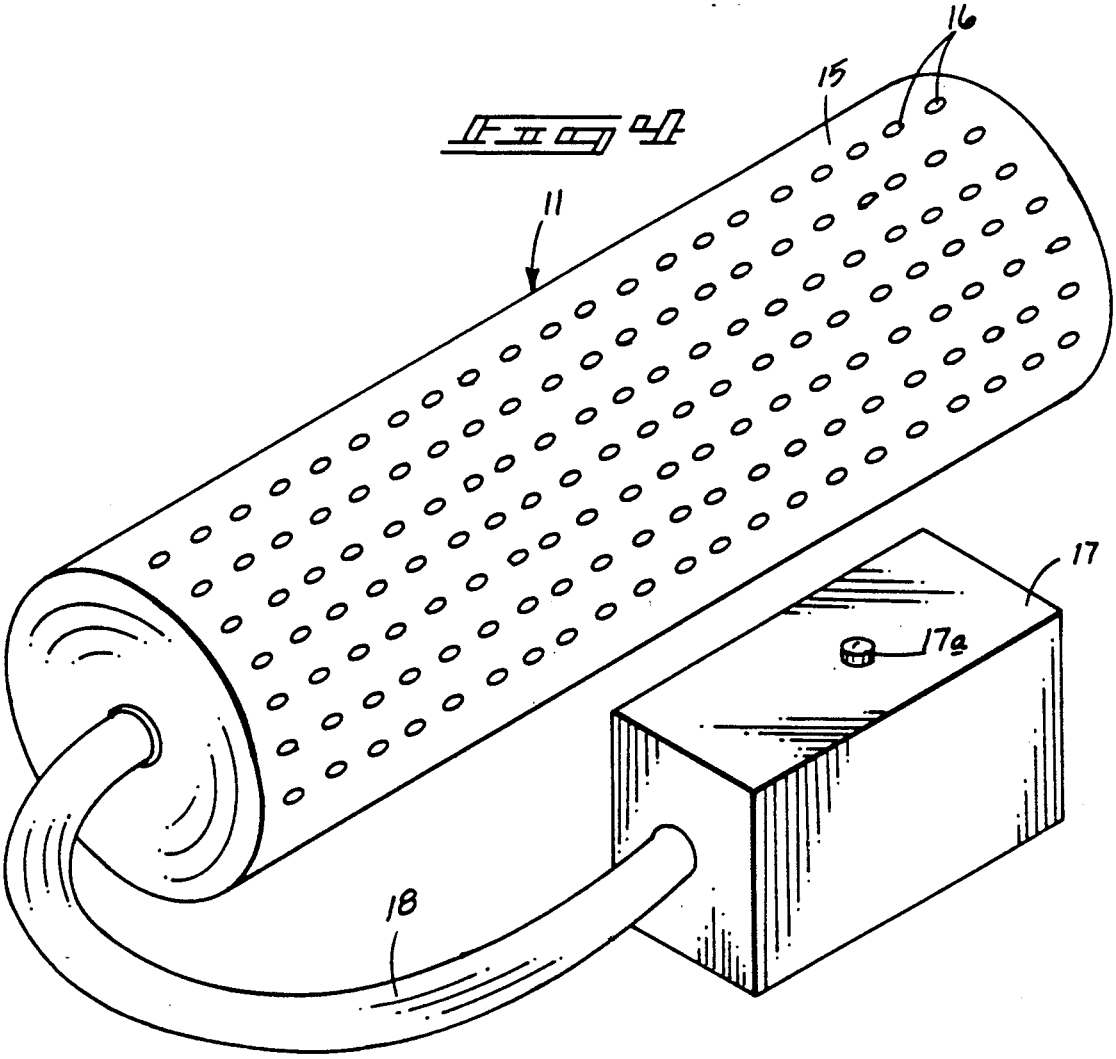
FIG. 4 is an isometric illustration of the pressurized cylinder of the instant invention.

The instant invention, as illustrated in FIG. 3 for example, utilizes a water feed roller 11, preferably formed of stainless steel, to impart water to plurality of water form rollers comprising an upper water form roller 12 and a lower water form roller 13 that in turn impart fluid to the associated plate cylinder 14. Ink may be imparted to the plate cylinder 14 in a conventional manner, such as that illustrated in U.S. Pat. No. 3,911,815 incorporated herein by reference.

The water feed roller 11 utilizes a pressurized water system including a fluid pump 17 operative through a control switch **17*a* to vary pressure to a delivery conduit 18. The delivery conduit 18 directs water interiorly of the water feed roller 11. The water feed roller 11 includes a cylindrical wall 15 that comprises a matrix of water feed apertures 16 that direct the water to the upper and lower water form rollers 12 and 13, as illustrated in FIG. 3** for example.

The water feed roller 11 includes a series of divided chambers formed by chamber walls defined by the first annular chamber wall 19 that also forms a forward end of the feed roller 11 with a second annular chamber wall 20, a third annular chamber wall 21, a fourth annular chamber wall 22, a fifth annular chamber wall 23, a sixth annular chamber wall 24, a seventh annular chamber wall 25, and an eighth annular chamber wall 26 spaced equally relative to one another to define the respective chambers therewithin. The chambers are defined by a first chamber 27, a second chamber 28, a third chamber 29, a fourth chamber 30, a fifth chamber 31, a sixth chamber 32, and a seventh chamber 33. It is desired that seven chambers be utilized, but of course greater quantities of chambers may be provided to provide a finer gradient of pressures directed to each of the form rollers. Each of the chambers are in a fluid sealed relationship relative to each other to maintain pressure within any one of the chambers uninfluenced by an adjacent chamber. Each of the chambers direct fluid therefrom through the feed apertures 16. The feed apertures 16 (with reference to FIG. 6) each include an elongate conduit with a check ball **16*a* formed at an upper end thereof that may be resiliently maintained and positioned against a constricted mouth of each of the conduits of the apertures 16, wherein a coil spring 16*b* resting upon an apertured shelf 16*c* normally biases the associated check ball 16*a* into sealing relationship with the mouth of each of the chambers. The check ball is of a greater diameter than the mouth of each of the apertures 16, whereupon engagement with an associated roller, such as a form roller 12**, depresses the associated check ball and allows water flow therethrough under pressure to be imparted upon the surface of the associated form roller.

Figure 5:
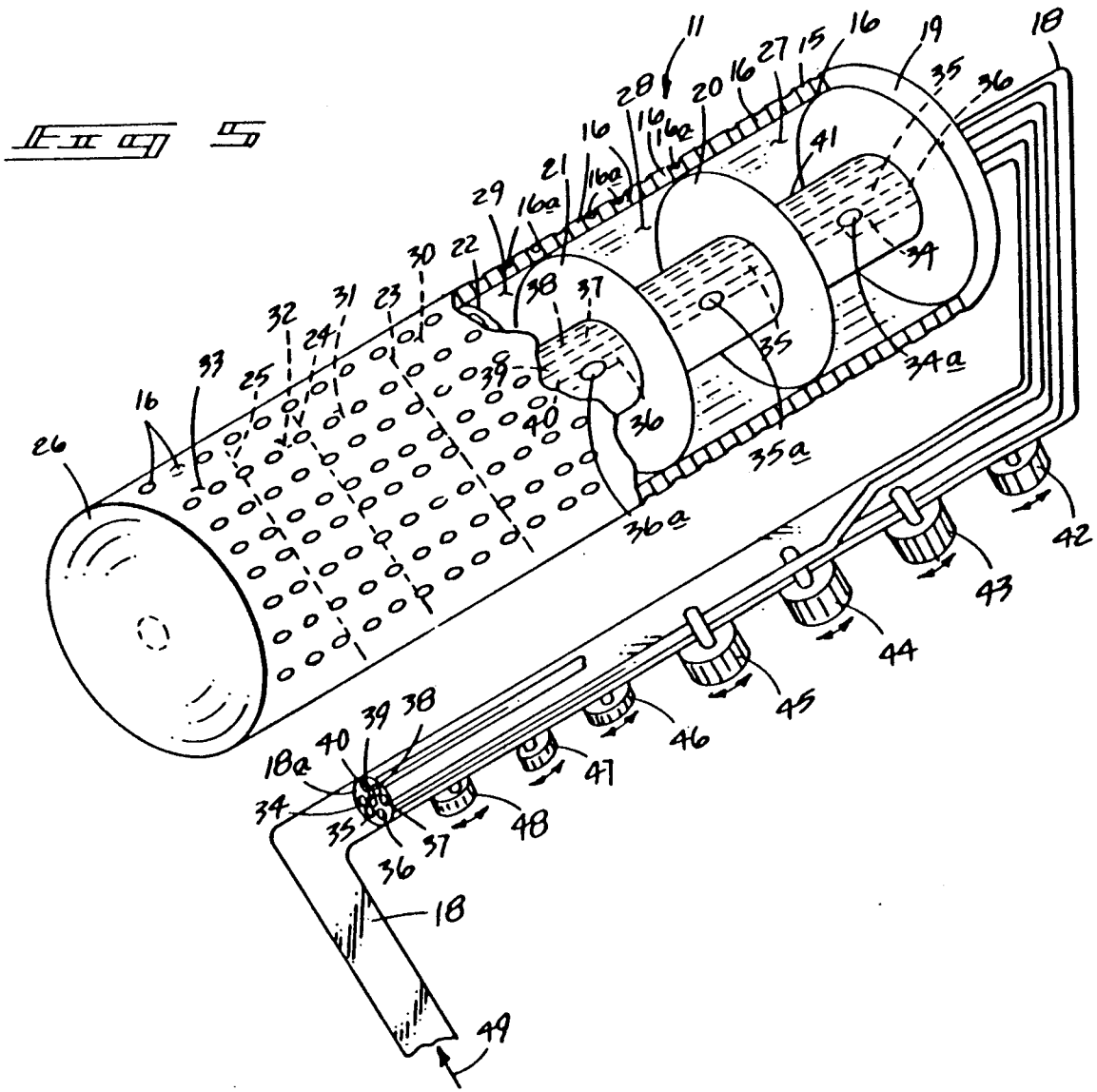
FIG. 5 is an isometric illustration, partially in section, illustrating the forced flow cylinder of the instant invention.
Figure 6:
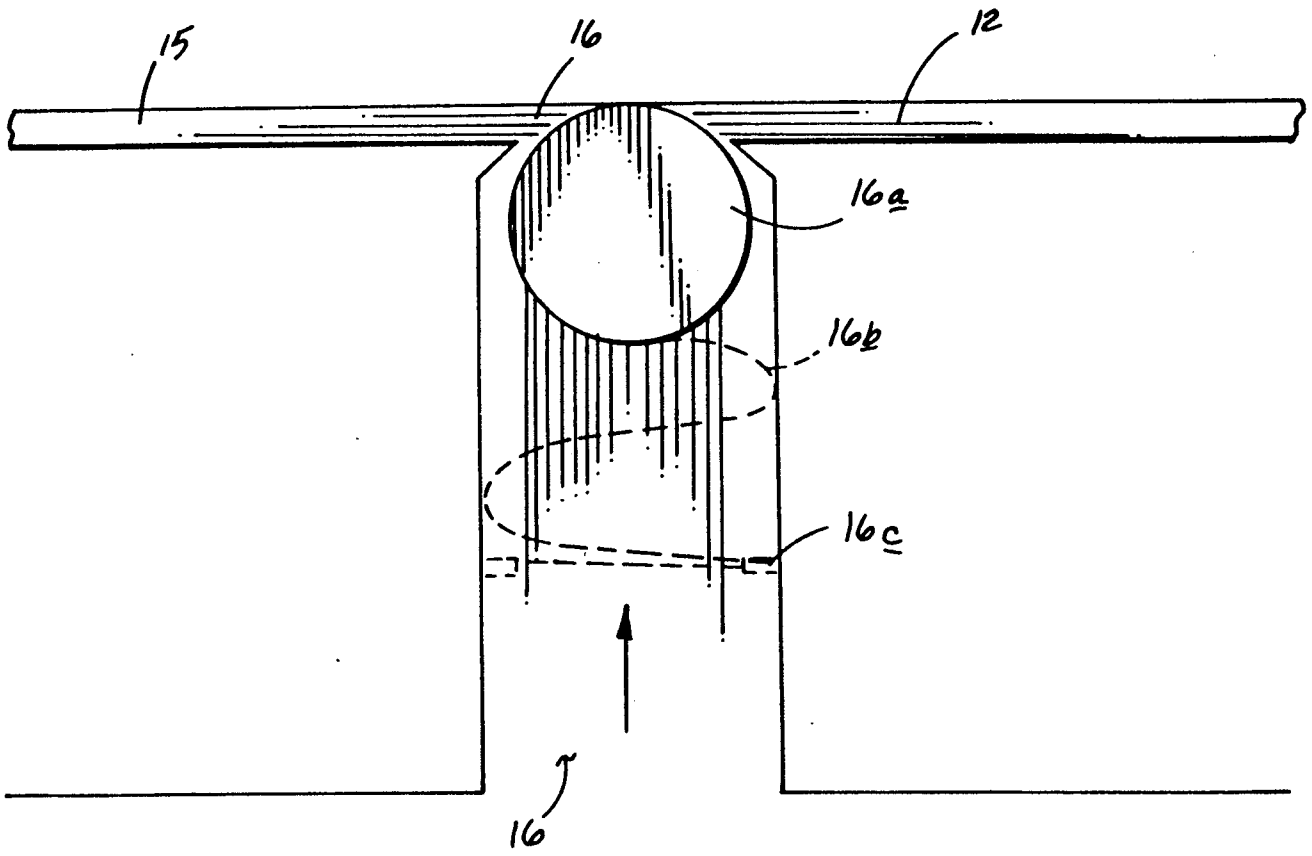
FIG. 6 is an orthographic cross-sectional view of a metered orifice formed within the surface wall of the forced flow cylinder of the instant invention.

Each of the aforenoted chambers 27 through 33 include a delivery conduit associated therewith. An individual delivery conduit is directed to each of the chambers and comprises first chamber conduit 34, a second chamber conduit 35, a third chamber delivery conduit 36, a fourth chamber delivery conduit 37, a fifth chamber delivery conduit 38, a sixth chamber delivery conduit 39, and a seventh chamber delivery conduit 40, each provided with an associated outlet defined by first outlet **34*a*, second outlet 35*a*, third outlet 36*a*, fourth outlet 37*a*, fifth outlet 38*a*, sixth outlet 39*a*, and seventh outlet 40***a*, wherein each of the outlets are directed through a common cylinder axle 41 that the annular chamber walls 19 through 26 are rotatably mounted about. The stationary cylinder axle 41 houses all of the associated delivery conduits and their associated outlets. Further, each of the delivery conduits 34 through 40 each include an associated valve, as illustrated in FIG. 5, comprising first valve 42, second valve 43, third valve 44, fourth valve 45, fifth valve 46, sixth valve 47, and seventh valve 48, each of the respective valves 42 through 48 associated with a respective delivery conduit 34 through 40. The valves enable selective fluid flow into each of the associated chambers and thereby enable providing a flow gradient emanating and directed through the associated water feed apertures 16 onto an associated water form roller. As illustrated in FIG. 5, each of the fluid chamber delivery conduits 34 through 40 are formed within a fluid manifold 18*a* within the delivery conduit 18, wherein water flow, indicated by arrow 49, is directed through the delivery conduit 18 into the fluid manifold 18*a* whereupon metered delivery into each of the various chambers is effected by the associated valving 42 through 48.

It should be understood therefore that any desired gradient may be provided across the longitudinal surface of the water feed roller 11 and thereby meter the water ultimately directed onto the plate cylinder 14.

As to the manner of usage and operation of the instant invention, the same should be apparent from the above disclosure, and according no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A printing press dampening apparatus in combination with a rotary printing machine, wherein the machine includes a plate roller and at least one transfer roller to direct fluid onto a surface of the plate roller, and a water feed roller to direct water to the transfer roller, the water feed roller including pressurizing means for directing pressurized fluid interiorly of the water feed roller, and a matrix of metered apertures for directing the fluid from interiorly of the water feed roller to the transfer roller and wherein each of the metered apertures comprises a conduit orthogonally oriented relative to a cylindrical surface defined by the water feed roller, each of the conduits including a tapered opening within the surface of the water feed roller, and a spherical check ball normally biased to close the tapered opening in a first position and repositioned to a second position spaced from the tapered opening upon contact of the spherical check ball with the transfer roller.

2. A printing press dampening apparatus as set forth in claim 1 wherein the pressurizing means comprises a fluid pump, the fluid pump including a control switch to vary fluid output from the fluid pump, and a fluid delivery conduit directed from the fluid pump axially of the water feed roller, and the fluid conduit including a predetermined array of fluid chamber delivery conduits positioned interiorly of the fluid delivery conduit and directed interiorly of the water feed roller coaxially thereof, the water feed roller including a cylinder axle directed therethrough and the fluid delivery conduit positioned within the cylinder axle of the water feed roller.

3. A printing press dampening apparatus as set forth in claim 1 wherein each of the predetermined number of chamber delivery conduits includes a respective outlet, each outlet of the predetermined number of chamber delivery conduits spaced relative to one anotherr within the water feed roller.

4. A printing press dampening apparatus as set forth in claim 3 further including a series of spaced annular chamber walls coaxially mounted to the cylinder axle and spaced interiorly in a fluid sealing relationship relative to one another within the water feed roller to define a further predetermined number of chambers, each of the chambers equal to the predetermined number of chamber delivery conduits and a predetermined number of outlets, and a single outlet associated in fluid communication interiorly of each chamber.

5. A printing press dampening apparatus as set forth in claim 4 wherein the predetermined number of chambers, chamber delivery conduits, and predetermined number of outlets are of a predetermined number less than that defined by the further predetermined number of annular chamber walls.

6. A printing press dampening apparatus as set forth in claim 5 wherein each of the chambers of the conduits includes an associated valve to vary water flow through each of the chambers of the delivery conduits interiorly of each of the chambers.

7. A printing press dampening apparatus as set forth in claim 6 wherein the predetermined number of chamber delivery conduits is axially positioned relative to each of the chambers, and includes a single conduit associated with each chamber.

* * * * *